United States Patent [19]

Limebeer

[11] 3,969,448

[45] July 13, 1976

[54] HEAT EXCHANGERS

[75] Inventor: Gerald J. N. Limebeer, Johannesburg, South Africa

[73] Assignee: Basil Gilbert Alfred Lund, Johannesburg, South Africa; a part interest

[22] Filed: Dec. 23, 1974

[21] Appl. No.: 535,342

Related U.S. Application Data

[62] Division of Ser. No. 334,215, Feb. 21, 1973, Pat. No. 3,885,936.

[30] Foreign Application Priority Data

Mar. 1, 1972 South Africa ..... 72/1381

[52] U.S. Cl. ..... 261/112; 62/305; 165/115

[51] Int. Cl.[2] ..... A23C 3/04; F28F 1/02; F28F 13/06

[58] Field of Search ..... 261/153, 112, 97; 55/241, 240; 165/115; 62/305, 310, 314

[56] References Cited

UNITED STATES PATENTS

| | | | |
|---|---|---|---|
| 1,866,193 | 7/1932 | Coutant | 261/112 |
| 3,292,998 | 12/1966 | James | 261/153 |
| 3,885,936 | 5/1975 | Limebeer | 261/DIG. 11 |

FOREIGN PATENTS OR APPLICATIONS

| | | | |
|---|---|---|---|
| 807,796 | 1937 | France | 165/172 |
| 612,340 | 1926 | France | 165/172 |
| 444,964 | 1936 | United Kingdom | 165/172 |

*Primary Examiner*—Tim R. Miles
*Assistant Examiner*—Gregory N. Clements
*Attorney, Agent, or Firm*—Young & Thompson

[57] ABSTRACT

A heat exchanger is composed of vertical tubes of cuspate, symmetrical aerofoil section. The chords are parallel to the air flow. The tubes are in parallel rows that interpenetrate so that each tube forms parallel-sided passages with two tubes leading it. The ratio of width to length of these passages if between 0.3 and 1.0. The tubes are spaced apart at various levels by means of inclined spacers. At the top of the tubes water is fed around them from a launder via a system of spacers. The spacers lower down serve to redistribute the water running down the flanks of the tubes. At the base there is an inclined platform on which the water is collected and fed to a launder. This water may be recirculated with additions to replace water lost by evaporation.

10 Claims, 6 Drawing Figures

HEAT EXCHANGERS

Figure 1:
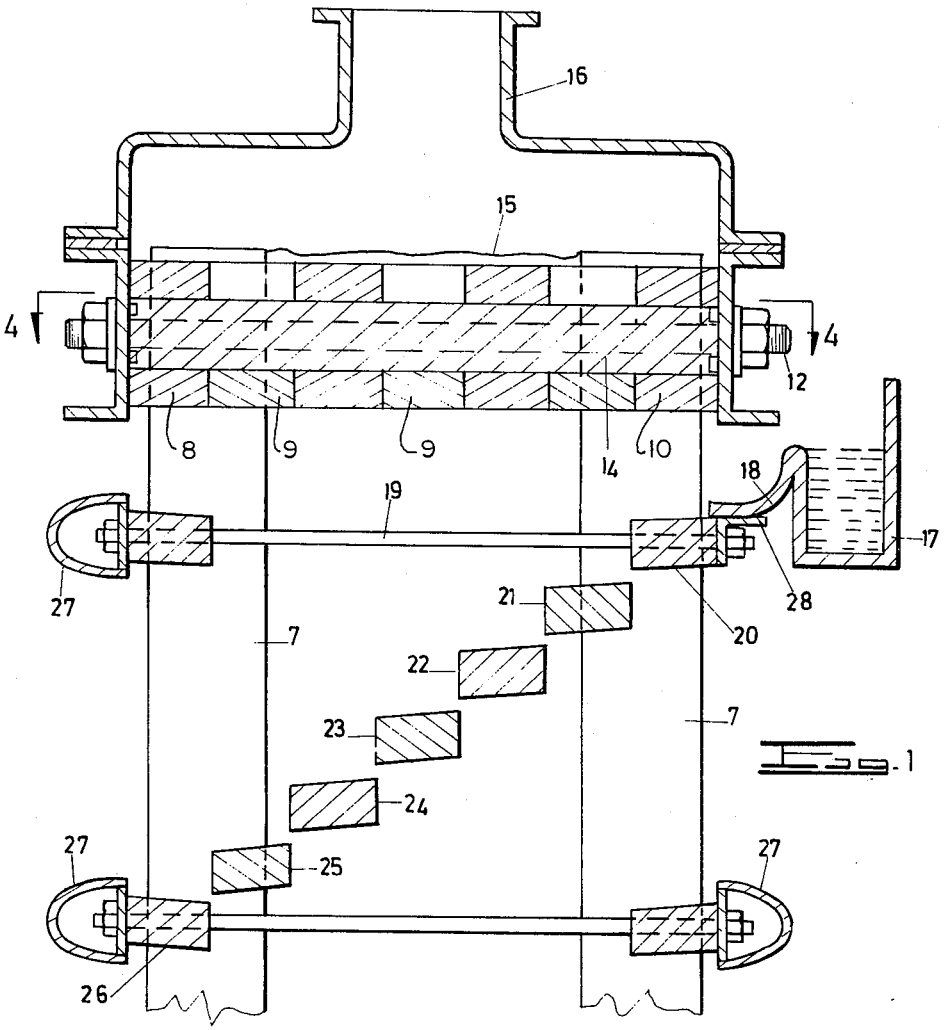

This invention relates to heat exchangers and this application is a division of U.S. patent application Ser. No. 334,215 filed Feb. 21, 1973, now U.S. Pat. No. 3,885,936.

This invention is particularly concerned with heat exchangers of the type comprising a multiplicity of tubes extending between tube sheets for a first fluid (usually a liquid such as water) to flow in the tubes and a second fluid (usually a gas and mainly air) to flow in a direction normal to an aperture plane, that is, the plane of the opening of the heat exchanger through which the air enters, the tubes being in a plurality of rows parallel to the aperture plane and parallel to one another. The present invention is particularly concerned with heat exchangers that are suitable for use in natural draught cooling towers as are used in major power generating installations.

In these latter installations so called "dry-cooling" is being experimented with on a large scale. As far as the applicant is aware these experiments involve using heat exchangers of conventional type in which the tubes are provided with a type of extended surface composed of fins in a plane which is substantially normal to the axis of the tubes. It should be noted that various shapes have been proposed for these finned tubes including circular, oval, elliptical, and aerofoil section.

Heat exchangers with finless tubes have already been proposed, for example in French Pat. No. 807,796. As far as the applicant is aware these heat exchangers have not been used in natural draught cooling towers.

It has already been proposed to augment the sensible heat transfer with a proportion of latent heat or mass transfer. In these proposals water is sprayed into the air stream entering the heat exchanger or poured or sprayed into the heat exchanger. In the former case the water should be of boiler quality to avoid the risk of depositing scale on the heat exchanger surfaces. Furthermore if water is sprayed or poured into the heat exchanger, the water tends to form a meniscus between closely spaced fins which interferes with the flow of air.

In the heat exchanger of the invention such augmenting is achieved by arranging the planes of symmetry of heat exchanger tubes to be substantially vertical and providing means for applying a liquid to the top of the exterior surfaces of the tubes for a continuous film of the liquid to form at least on the flanks of each tube.

Further according to the invention the heat exchanger includes a series of spacers extending along rows of tubes, the spacers in plan forming a continuous surface but being stepped in elevation and inclined against the flow of the second fluid, and including a liquid feeding device to feed liquid evenly on to the top of the top spacer.

Preferably the spacers run parallel to the aperture plane and the top spacer is at the rear of the heat exchanger.

The heat exchanger further includes a channel parallel to the top spacer, an overflow weir along on edge of the channel and an apron from the weir to the top spacer.

Series of these spacers are also positioned at suitable intervals down the lengths of the tubes to effect redistribution of liquid running down the tubes.

Since there is a continuous film the purity of the water used is not of any great concern. In addition the film of water does not interfere with the overall performance of the heat exchanger to any significant extent. But the latent heat of evaporation is used to a considerable extent to cool the fluid flowing in the tubes.

Figure 2:
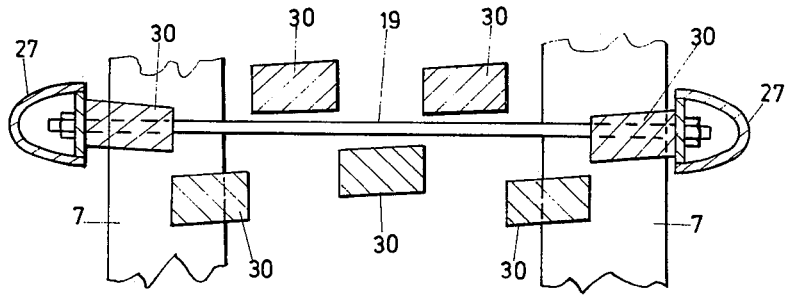
Figure 3:
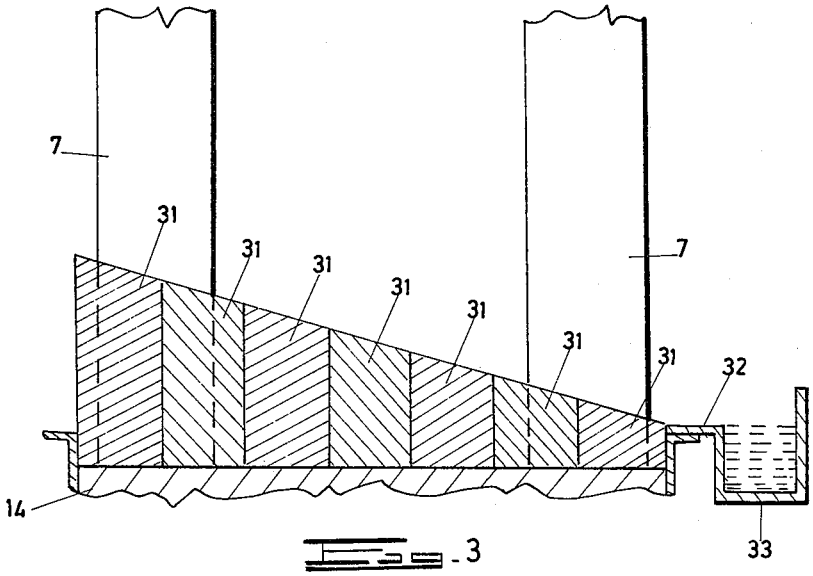
Figure 4:
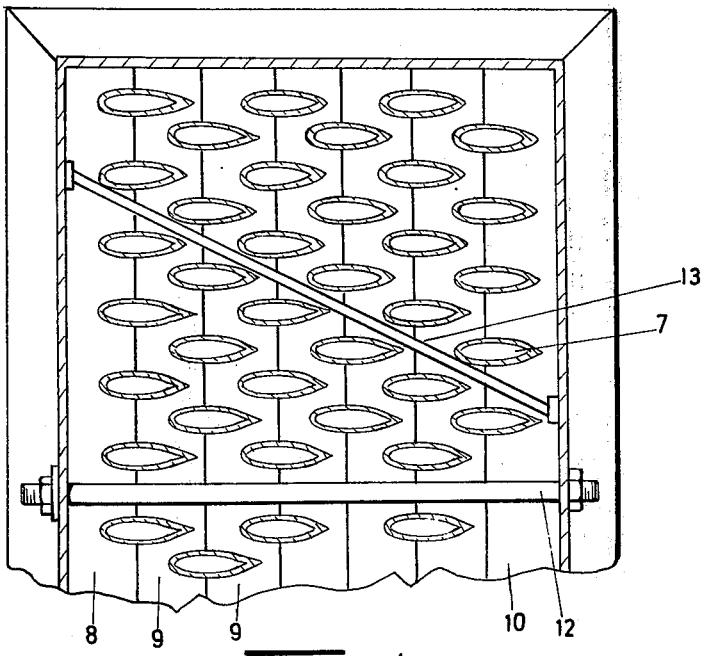
Figure 6:
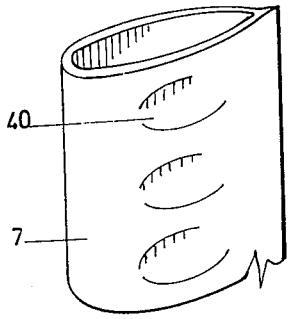
Figure 5:
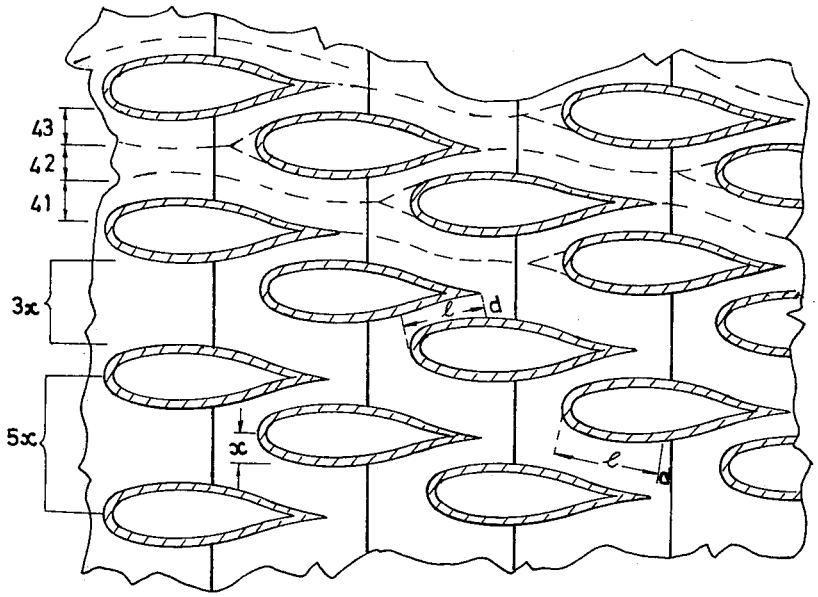

The invention is further discussed with reference to the accompanying drawings, in which:

FIG. 1 is a vertical section through the top of a heat exchanger according to the invention, FIG. 2 is a similar view further down the heat exchanger, FIG. 3 is again a similar view of the heat exchanger just above the bottom tube sheet, FIG. 4 is a plan view on the line 4—4 of FIG. 1, FIG. 5 is an enlarged view of an alternative to FIG. 4 with components left out, and FIG. 6 is a fragmentary view of a form of heat exchanger tube.

FIG. 1 is a section through the top tube sheet of a heat exchanger and should be read in conjunction with FIG. 4. First there are a plurality of tubes 7 of which a large number are shown in FIG. 4 while for the sake of clarity only two appear in FIGS. 1 to 3.

The tubes 7 are of symmetrical aerofoil section with cuspate trailing edges, i.e. the trailing edges are as close to knife edges as is practicable. More will be said later on with reference to FIG. 5 about the tubes 7 and their arrangement. For the moment it is to be noted that they are placed in a number of rows and that in the illustrated example there are six rows. Depending on the circumstances there could be a larger or less number of rows.

Each tube is positioned with its plane of symmetry or the chord plane of its aerofoil section in the direction of air flow. The plane of symmetry is thus at right angles to the aperture plane of the heat exchanger. The arrow A indicates the direction of air flow.

The tubes 7 extend between tube sheets at the top and the bottom. Each tube sheet is the inverse of the other except for a difference to be pointed out later on. The top tube sheet is illustrated in FIG. 1.

The ends of the tubes 7 are assembled with the aid of strips cut from stiff extruded sheets of plastics. As can be seen from FIG. 4 there are three kinds of strips 8, 9 and 10. The strips are extruded in a direction normal to the paper in FIG. 4 and cut to provide strips as shown in FIG. 1. The strips 8 are formed to accommodate the noses of leading tubes, the strips 9 accommodate at one side the tails of the tubes and at the other side the noses of the tubes, while the strips 10 accommodate the cusps of the trailing row of tubes.

There are two layers of these strips in each tube sheet and the layers are spaced apart to provide a space that accomodates tie bolts 12 and reinforcing rods 13 (FIG. 4). After assembly the space is filled with a suitable self-setting grout or mortar 14 such as an epoxy concrete (FIG. 1).

The top layer of strips is covered with a neoprene seal 15 (FIG. 1).

The tube sheet is covered with a water box 16 having a suitable feed water connection.

Just below the top tube sheet there are a series of spacer strips similar to those in the tube sheet, but with inclined top surfaces. The spacer strips 20–26 are placed at suitably stepped vertical intervals. A feed trough 17 with an apron 18 leads water on to the top strip 20. The water cascades down until the strip 26 is reached. The latter has a slope opposite to the other strips. The strips 20–26 are spaced vertically so as to allow water to escape between them in the direction of the air current. Thus films of water are caused to gravitate down the flanks of the tubes 7. Secondary tie rods 19 between strong backs 27 and an angle iron 28 serve to clamp the assembly together.

It is contemplated that a heat exchanger of the invention will in practice be as tall as 15 meters. In order to effect redistribution of water that gravitates down and is forced to the right in FIG. 1 by the air flow, additional spacers 30 are provided at intervals of 1.75 meters or so down the heat exchanger. At the same time further secondary tie rods 19 and strong backs 27 are provided in the zone of these redistribution spacers 30. Such a zone is illustrated in FIG. 2.

In the bottom tube plate (which is the inverse of the top one) the top row of strips are cut to form an inclined surface as shown in FIg. 3. In this Figure the inclined strips have been marked 31. At the rear the inclined surface leads to the lip 32 of a gutter 33. It will of course be understood that as many assemblies of strips 20–26 and spacers 30 can be vertically superposed as desired, and that water from gutter 33 can be returned to water box 16 or otherwise disposed of.

The heat exchanger thus far described can be used for sensible heat transfer when required and when this has to be augmented by latent heat of evaporation, water is fed into the trough 17 and to such an extent that water is continuously flowing down all the tubes 7 and collected in the gutter 33. The water thus collected can be recirculated after making up losses due to evaporation.

The configuration and arrangement of the tubes 7 is shown in greater detail in FIG. 5 which is approximately full scale, the chord length of the tubes being about 37.5 mm. In practice this chord length can vary between 25 mm and 75 mm. The fineness ratio of the tubes as illustrated is at the optimum of about 4:1. A greater fineness ratio of up to 6:1 will work, but then the liquid capacity of the system may suffer. Smaller ratios up to 2:1 can be used, but then the resistance to air flow becomes bigger.

A convenient arrangement of the tubes 7 to stagger them in rows so that the chord plane of one row is midway between the chord plane of another row as shown in FIG. 4. However, for a given population density of tubes 7 the cusps and noses of tubes that are in line will in many practical cases be so close together that the boundary layer from the one will slip on to the other behind it without mixing with the balance of the air stream.

The preferred arrangement is elucidated in FIG. 5. As a spacing module half the maximum tube thickness has been chosen. In a row the tubes are spaced laterally apart by three modules or their chord planes by five modules. The next row partly penetrates the row leading it and is staggered so that each tube chord plane is two modules from the chord plane leading it on the right and three chord planes from the chord plane of the tube leading it on the left. In the result every sixth row is a repeat of another row.

In this embodiment the cold air stream entering between a pair of leading tubes can be considered as composed of three layers as illustrated in the top part of FIG. 5. The three layers are shown separated by dotted lines and have been marked 41, 42 and 43. A point at the interface between any pair of layers moves more than a row spacing before it comes on to the surface of a trailing tube. Thus there is a considerable chance of mixing between the two air streams and particularly that heat taken up by a boundary layer coming off a tube will be dissipated into the two air streams to either side of it before it again becomes a boundary layer. In the embodiment of FIG. 4 a boundary layer slips across a small gap behind a cusp before it again becomes a boundary layer.

In the direction of air flow each tube penetrates between pairs of tubes leading it to such an extent that the passages formed have ratios of width to length of 0.3 to 1.0. In FIG. 5 the dimensions "*d*" and "*l*" are given. The ratio *d:l* is about 0.3 in the case of the narrower passages and less than 1.0 in the case of the wider passages. In FIG. 4 the passages are all of the same width and the ratio of *d:l* is about 1.0.

Furthermore the aerofoil sections are so chosen that these passages are of substantially constant width along their lengths. In the example of FIG. 5 this means a spacing in the direction of air flow of 25 mm from chord centre to chord centre when the chord length is 37.5 mm.

The wide passages in FIG. 5 are all in line but obliquely to the direction of air flow. In the tubes sheets they provide accommodation for the reinforcing rods 13.

The tubes illustrated in FIGS. 1 to 5 all have smooth sides so that sections taken at any horizontal plane will be the same. If certain thin gauges of sheet metal are used in making them, they may not be strong enough. In such a case the expedient shown in FIG. 6 may be used. Here the flanks of a tube 7 are formed with a series of indentations 40 along its length. The identations all lie within the original aerofoil section and there are no air side protrusions beyond that section.

It will be seen that the heat exchanger of the invention is simple to manufacture and easy to assemble. It is expected to be considerably cheaper than conventional heat exchangers of comparable size for the same duty.

The absence of any form of fin allows for the attainment of an optimum spaced relationship between the tubes. There is no temperature drop of the kind associated with fins. The form drag of the whole system has been made as low as practicable. The heat exchanger has an improved overall pressure drop efficiency factor compared to finned types of heat exchangers. The heat exchange tubes may be made from relatively inexpensive material of high strength and low thermal conductivity such as corrosion resistant alloy steel.

I claim:

1. A liquid cooler comprising a multiplicity of tubes extending between tube sheets and means supplying a liquid at an elevated temperature to flow in the tubes and ambient air to flow past the tubes in a direction normal to an aperture plane, the tubes being in a plurality of rows parallel to the aperture plane and parallel to one another, having their longitudinal axes substantially vertical being formed with continuous exterior surfaces from end to end so that there are no heat transfer surfaces extending into the path of the air, and being formed as streamlined bodies facing the air stream, and means for flowing water on to the top of the exterior surfaces of the tubes for a continuous film of the water to form at least on the flanks of the tubes being traversed by the air.

2. The cooler claimed in claim 1 including a series of spacers extending along the tops of rows of tubes, the spacers in plan forming a continuous surface but being stepped in elevation and inclined against the flow of the air and including a water feeding device to feed water evenly on to the top of the top spacer.

3. The cooler claimed in claim 2 in which the spacers run parallel to the aperture plane and the top spacer is at the rear of the cooler.

4. The cooler claimed in claim 3 including a channel parallel to the top spacer, an overflow weir along one edge of the channel and an apron from the weir to the top spacer.

5. The cooler claimed in claim 4 including a series of spacers positioned at suitable intervals down the lengths of the tubes to effect redistribution of water running down the tubes.

6. A liquid cooler comprising a multiplicity of tubes extending between tube sheets and means supplying a liquid at an elevated temperature to flow in the tubes and ambient air to flow past the tubes in a direction normal to an aperture plane, the tubes being in a plurality of rows parallel to the aperture plane and parallel to one another, in which each tube is of a symmetrical aerofoil section with a cuspate trailing edge and with its chord plane normal to the aperture plane and being formed within a continuous aerofoil aperture plane and being formed within a continuous aerofoil shape from end to end so that there are no heat transfer surfaces extending into the path of the air, and in which the tubes are so shaped and rows of tubes are so positioned that the nose of a tube in a trailing row of tubes intercallates between the trailing edges of pairs of tubes in the leading row so that between adjacent trailing and leading tubes passages of substantially constant width along their lengths in the direction of flow of the second fluid are formed and means for applying water to the top of the exterior surfaces of the tubes for a continuous film of the water to form at least on the flanks of each tube.

7. The cooler claimed in claim 6 including a series of spacers extending along the tops of rows of tubes, the spacers in plan forming a continuous surface but being stepped in elevation and inclined against the flow of the air, and including a water feeding device to feed water evenly on to the top of the top spacer.

8. The cooler claimed in claim 7 in which the spacers run parallel to the aperture plane and the top spacer is at the rear of the cooler.

9. The cooler claimed in claim 8 including a channel parallel to the top spacer, an overflow weir along one edge of the channel and an apron from the weir to the top spacer.

10. The cooler claimed in claim 9 including a series of spacers positioned at suitable intervals down the lengths of the tubes to effect redistribution of water running down the tubes.

* * * * *